US007086842B2

(12) United States Patent
Wild

(10) Patent No.: US 7,086,842 B2
(45) Date of Patent: Aug. 8, 2006

(54) TURBOCHARGER

(75) Inventor: Philip Mark Wild, Holmfirth (GB)

(73) Assignee: Holset Engineering Company Limited (GB)

( * ) Notice: Subject to any disclaimer, the term of this patent is extended or adjusted under 35 U.S.C. 154(b) by 0 days.

(21) Appl. No.: 10/631,622

(22) Filed: Jul. 31, 2003

(65) Prior Publication Data

US 2004/0057847 A1 Mar. 25, 2004

(30) Foreign Application Priority Data

Aug. 3, 2002 (GB) ..... 0218092.5

(51) Int. Cl.

| | |
|---|---|
| ***F04B 17/00*** | (2006.01) |
| ***F04D 29/08*** | (2006.01) |
| ***F02B 39/00*** | (2006.01) |
| ***F02B 39/16*** | (2006.01) |
| *F04B 35/00* | (2006.01) |
| *F01D 11/00* | (2006.01) |
| *F01D 25/18* | (2006.01) |

(52) U.S. Cl. ..... 417/407; 415/111; 416/174; 184/6.11

(58) Field of Classification Search ..... 417/407; 415/111, 112, 229; 416/174; 184/6.11
See application file for complete search history.

(56) References Cited

U.S. PATENT DOCUMENTS

| | | | | |
|---|---|---|---|---|
| 146,116 A | | 12/1873 | Whitaker et al. | 384/165 |
| 1,597,147 A | | 8/1926 | Danne | |
| 1,601,115 A | | 9/1926 | Fuller | |
| 1,865,951 A | | 7/1932 | Peyinghaus | |
| 1,945,219 A | | 1/1934 | Fruhstorfer | |
| 1,988,490 A | | 1/1935 | Harrison | |
| 2,254,862 A | | 9/1941 | Watson et al. | |
| 2,589,631 A | | 3/1952 | Schmitz | |
| 2,770,972 A | | 11/1956 | Gratzmuller | 74/49 |
| 2,829,932 A | | 4/1958 | Werner | |
| 3,044,837 A | | 7/1962 | Beaney | |
| 3,049,356 A | | 8/1962 | Talamonti | |
| 4,157,881 A | | 6/1979 | Kasuya | 417/407 |
| 4,268,229 A | | 5/1981 | Berg | 417/407 |
| 4,389,052 A | * | 6/1983 | Shimizu et al. | 415/111 |
| 4,880,351 A | | 11/1989 | Inoue et al. | |
| 6,418,722 B1 | * | 7/2002 | Arnold | 417/407 |
| 6,837,677 B1 | * | 1/2005 | Zhang et al. | 416/174 |
| 2004/0120835 A1 | * | 6/2004 | O'Hara | 417/407 |

FOREIGN PATENT DOCUMENTS

| | | | |
|---|---|---|---|
| EP | 1179655 | | 2/2002 |
| JP | 61135941 A | * | 6/1986 |
| JP | 61167128 A | * | 7/1986 |
| JP | 05065829 A | * | 3/1993 |

* cited by examiner

*Primary Examiner*—Thai-Ba Trieu
(74) *Attorney, Agent, or Firm*—Krieg DeVault LLP

(57) ABSTRACT

A turbocharger having a turbine wheel mounted to a seal boss at one end of a shaft and a compressor wheel mounted to the other end of the shaft. The seal boss includes an annular face angled relative to a radial plane extending through the shaft so that as the shaft rotates oil present on the annular face is projected into an oil collecting groove in a direction radially away from the shaft and axially away from an annular passage in a housing wall.

10 Claims, 3 Drawing Sheets

TURBOCHARGER

The present application claims priority to British Patent Application No. 0218092.5, filed Aug. 3, 2002, which is incorporated herein by reference.

The present invention relates to a turbocharger for an internal combustion engine. In particular, the present invention relates to the reduction of oil leakage from a turbocharger bearing housing into a turbocharger turbine housing.

Turbochargers are well known devices for supplying air to the intake of an internal combustion engine at pressures above atmospheric (boost pressures). A conventional turbocharger essentially comprises an exhaust gas driven turbine wheel mounted on a rotatable shaft within a turbine housing. Rotation of the turbine wheel rotates a compressor wheel mounted on the other end of the shaft within a compressor housing. The compressor wheel delivers compressed air to the intake manifold of the engine, thereby increasing engine power.

The turbocharger shaft is conventionally supported by journal and thrust bearings, including appropriate lubricating systems, located within a central bearing housing connected between the turbine and compressor wheel housing. It is well known that providing an effective sealing system to prevent oil leakage from the central bearing housing in to the compressor or turbine housing is problematical. Oil leakage is regarded as a particular problem at the compressor end of the turbocharger since at low boost pressures there can be a significant drop in pressure from the bearing housing to the compressor housing which encourages oil leakage into the compressor housing. It is for instance conventional to include an oil slinger in the compressor end seal assembly. An oil slinger is an annular component which rotates with the turbocharger shaft and has surfaces or passages arranged for propelling oil away from the shaft as it rotates, and in particular from the passage through the bearing housing into the compressor housing.

Although oil leakage at the turbine end of the turbocharger is regarded as less of a problem, it is nevertheless important to prevent oil leaking into the turbine housing where it will mix with the exhaust gas and increase exhaust emissions. The turbocharger turbine wheel is conventionally friction welded to a seal boss at the end of the turbocharger shaft, the seal boss having a larger diameter than the shaft and rotating within an annular passage through a housing wall separating the bearing housing from the turbine housing. Conventional oil seal arrangements comprise one or more seal rings located in the annular gap surrounding the seal boss within the passage providing a labyrinth seal in the manner of piston rings.

Oil leakage across the turbine end seal can become a problem as the engine wears and the engine crank case pressure increases as the sealing efficiency of the engine piston rings decreases. The oil drain from the turbocharger bearing housing is delivered to the engine crank case and thus any increase in crank case pressure is transmitted to the bearing housing which can result in "blow-by" across the turbine end seal. With increasingly stringent exhaust emission regulations there is a continuing need to improve the efficiency of the turbine end seal arrangement.

It is an object of the present invention to obviate or mitigate the problems of oil leakage from the turbocharger bearing housing into the turbocharger turbine housing.

According to the present invention there is provided a turbocharger comprising:

a turbine wheel mounted to a seal boss provided at one end of a shaft for rotation about an axis within a turbine housing;

a compressor wheel mounted to the other end of the shaft for rotation about said axis within a compressor housing;

the shaft rotating on bearing assemblies housed within a bearing housing located between the compressor housing and the turbine housing and provided with oil passages for delivering oil to the bearing assemblies;

the turbine wheel being separated from the interior of the bearing housing by a housing wall;

the seal boss extending through an annular passage provided through said housing wall and sealed with respect thereto by seal means disposed within an annular gap defined around the seal boss within the annular passage;

the seal boss having an inboard axial end which extends into the bearing housing and has an annular face forming a radial shoulder around the shaft;

the bearing housing defining an oil collecting groove radially recessed into the bearing housing adjacent said bearing housing wall and having an opening at least partially surrounding the shaft and axially overlapping the inboard end of the seal boss;

wherein the annular face of the seal boss is angled relative to a radial plane extending through the shaft so that as the shaft rotates oil present on the annular face of the seal boss is projected into the oil collecting groove in a direction radially away from the shaft and axially away from the passage through said housing wall.

Tests have shown that by the relatively simple expedient of propelling the oil axially away from the passage through the bearing housing wall, and thus away from the turbine end seal, oil leakage across the seal is significantly reduced. In preferred embodiments of the invention, the oil collecting groove has first and second facing side walls, the first side wall being inboard relative to the second side wall, and the seal boss is angled to project oil on to the second side wall rather than the first side wall.

The angled profile of the annular seal boss face may vary, but preferably the radially outer edge of the face will overhang the radially inner edge of the face. For instance, the annular face may be substantially frusto-conical.

The angled face may be formed by machining a recess of appropriate profile, e.g. an undercut, into an otherwise radially extending face. In other words, a conventional turbocharger shaft and turbine wheel assembly can readily be modified by appropriate machining of an otherwise conventional seal boss.

Other preferred and particularly advantageous features of the invention will be apparent from the following description.

Specific embodiments of the present invention will now be described, by way of example only, with reference to the accompanying drawings, in which.

Figure 1:
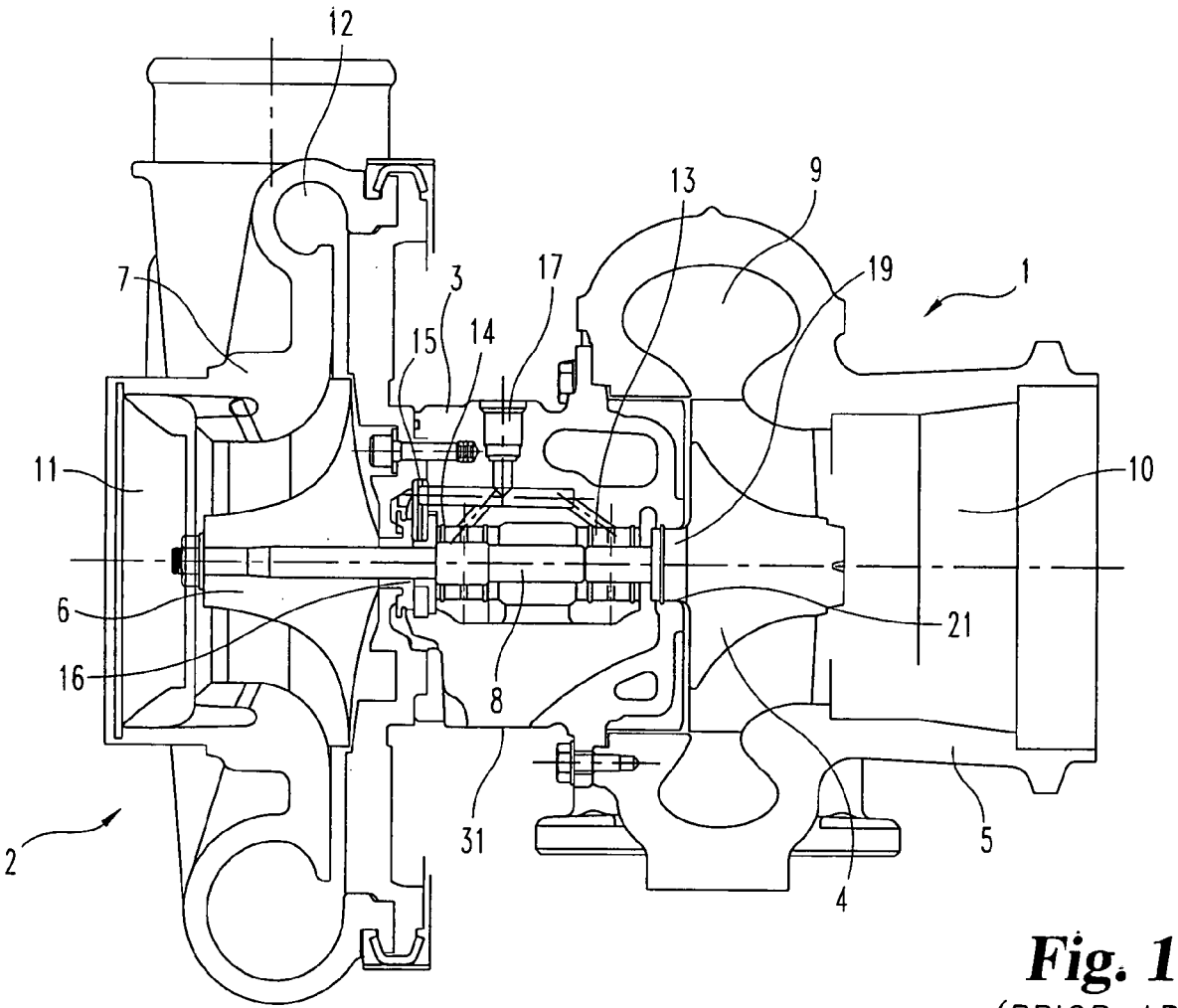
Fig. 1 (PRIOR ART)
FIG. 1 is a cross-section through a conventional turbocharger.
Figure 2:
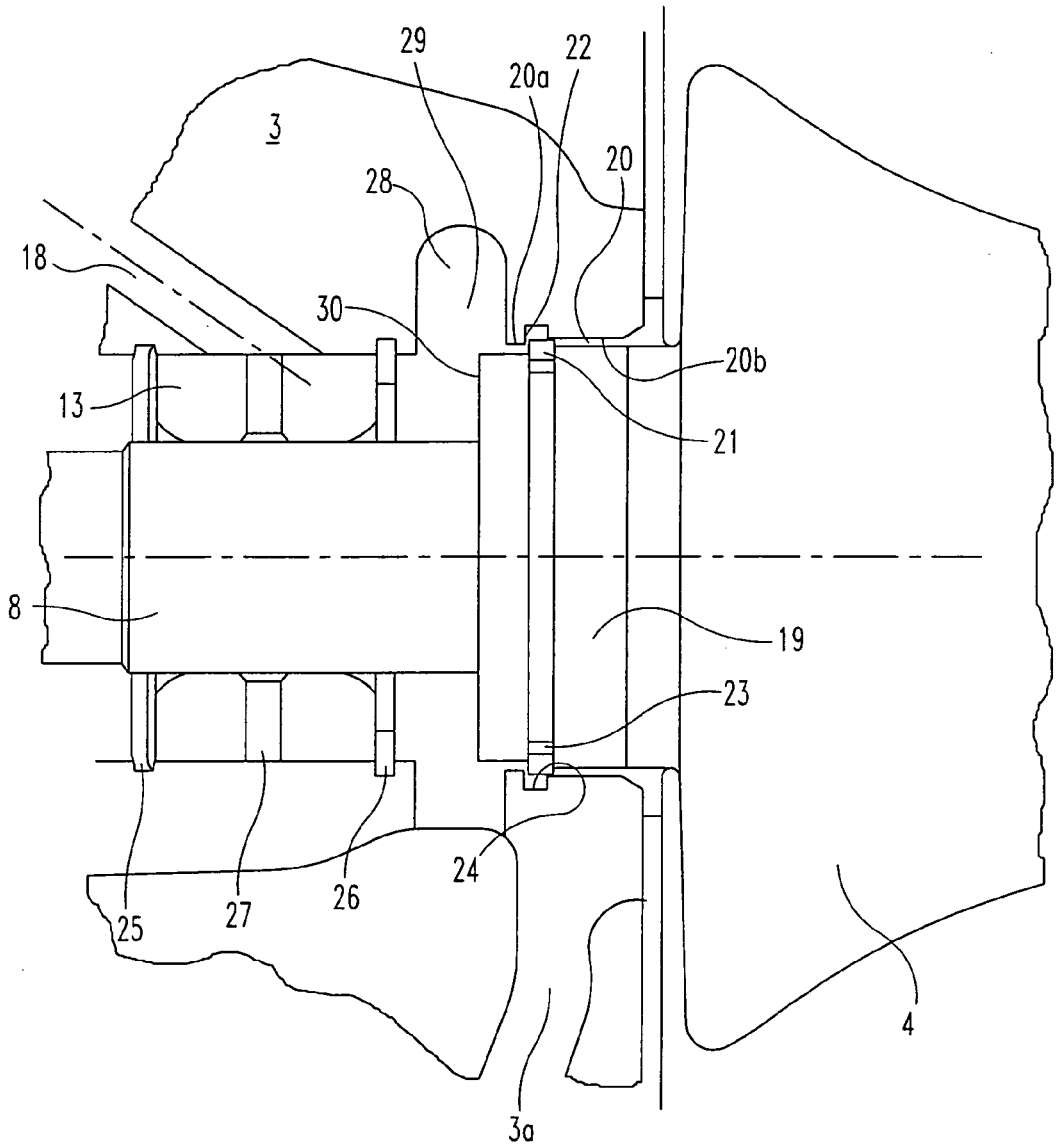
Fig. 2 (PRIOR ART)
FIG. 2 is an expanded view of the turbine end bearing and oil seal assemblies of the turbocharger of FIG. 1.

Referring to FIGS. 1 and 2, the illustrated turbocharger comprises a turbine 1 joined to a compressor 2 via a central bearing housing 3. The turbine 1 comprises a turbine wheel 4 rotating within a turbine housing 5. Similarly, the compressor 2 comprises a compressor wheel 6 which rotates within a compressor housing 7. The turbine wheel 4 and compressor wheel 6 are mounted on opposite ends of a common turbocharger shaft 8 which extends through the central bearing housing 3.

The turbine housing 5 has an exhaust gas inlet volute 9 located annually around the turbine wheel 4 and an axial exhaust gas outlet 10. The compressor housing 7 has an axial air intake passage 11 and a compressed air outlet volute 12 arranged annually around the compressor wheel 6.

In use, the turbine wheel 4 is rotated by the passage of exhaust gas from the annular exhaust gas inlet 9 to the exhaust gas outlet 10, which in turn rotates the compressor wheel 6 which thereby draws intake air through the compressor inlet 11 and delivers boost air to the intake of an internal combustion engine via the compressor outlet volute 12.

The turbocharger shaft 8 rotates on fully floating journal bearings 13 and 14 housed towards the turbine end and compressor end respectively of the bearing housing 3. The compressor end bearing assembly 14 further includes a thrust bearing 15 which interacts with an oil seal assembly including an oil slinger 16. Details of the compressor end bearing and oil seal are not important to an understanding of the present invention and will not be described further. Oil is supplied to the bearing housing from the oil system of the internal combustion engine via oil inlet 17 and is fed to the bearing assemblies by oil passageways 18.

The turbine end bearing assembly and oil seal is shown in greater detail in FIG. 2. The turbine wheel 4 is joined to the end of the turbocharger shaft 8 at a seal boss 19. Generally a first portion of the seal boss 19 is formed integrally with the shaft 8 and is joined (for instance by friction welding) to a second boss portion on the turbine wheel 4. The seal boss 19 extends through an annular passage 20 in a bearing housing wall 3*a* and into the turbine housings. The seal boss 19 is sealed with respect to the annular passage 20 by a seal ring 21 (piston ring).

In more detail (referring in particular to FIG. 2) the passage 20 through the bearing housing wall 3*a* is radially stepped having a relatively narrow diameter inboard portion 20*a* and a relatively large diameter outboard portion 20*b*. This provides an annular abutment shoulder 22 for the ring seal 21 which sits within an annular groove 23 provided in the outer surface of the seal boss 19. The seal ring 21 is stationary with respect to the bearing housing 3 and is provided to prevent the leakage of air/oil through the passage 20. The abutment shoulder 22 prevents the seal ring 21 creeping inboard towards the bearing housing 3. In order to provide an abrupt, none radiused, change of diameter of the passage 20 a slight annular recess 24 is cut back in to the surface of the annular passage 20 to define the shoulder 22.

The turbine end journal bearing 13 is located between circlips 25 and 26. Oil is fed to the bearing 13 via oil passageway 18 and the bearing 13 is provided with circumferentially spaced radial holes 27 for oil to pass to the turbocharger shaft 8. An annular oil return groove 28 is radially recessed into the bearing housing wall adjacent the passage 20 through the housing wall 3*a*. The oil return groove 28 surrounds the shaft 8 and has an entrance 29.

The seal boss 19 extends slightly into the bearing housing 18 beyond the inner surface of the bearing housing wall 3*a* and axially overlaps the entrance 29 to the oil groove 28. The inboard end of the seal boss 19 forms a radial shoulder around the shaft 8 having an annular face 30. As the turbocharger shaft 8 rotates, oil reaching the annular face 30 is radially dispelled and propelled from the face 30 of the boss 19 is into the oil groove 28 from which it drains back to the engine crank case via an oil drain hole 31 (shown in FIG. 1). The provision of the oil groove 28 thus prevents oil from accumulating in the region of the passage 20, and similarly ensuring that the boss 19 protrudes into the bearing housing 3 ensures that oil is projected into the oil groove 28 and not towards the annular gap defined where the boss 19 passes through the passage 20.

Investigations have however shown that with the conventional arrangement described above and illustrated in FIGS. 1 and 2, a significant portion of the oil propelled in to the oil groove 28 flows back along the inner wall of the bearing housing 3*a* to the passageway 20. The present invention, as exemplified by the embodiment illustrated in FIG. 3, addresses this problem.

Figure 3:
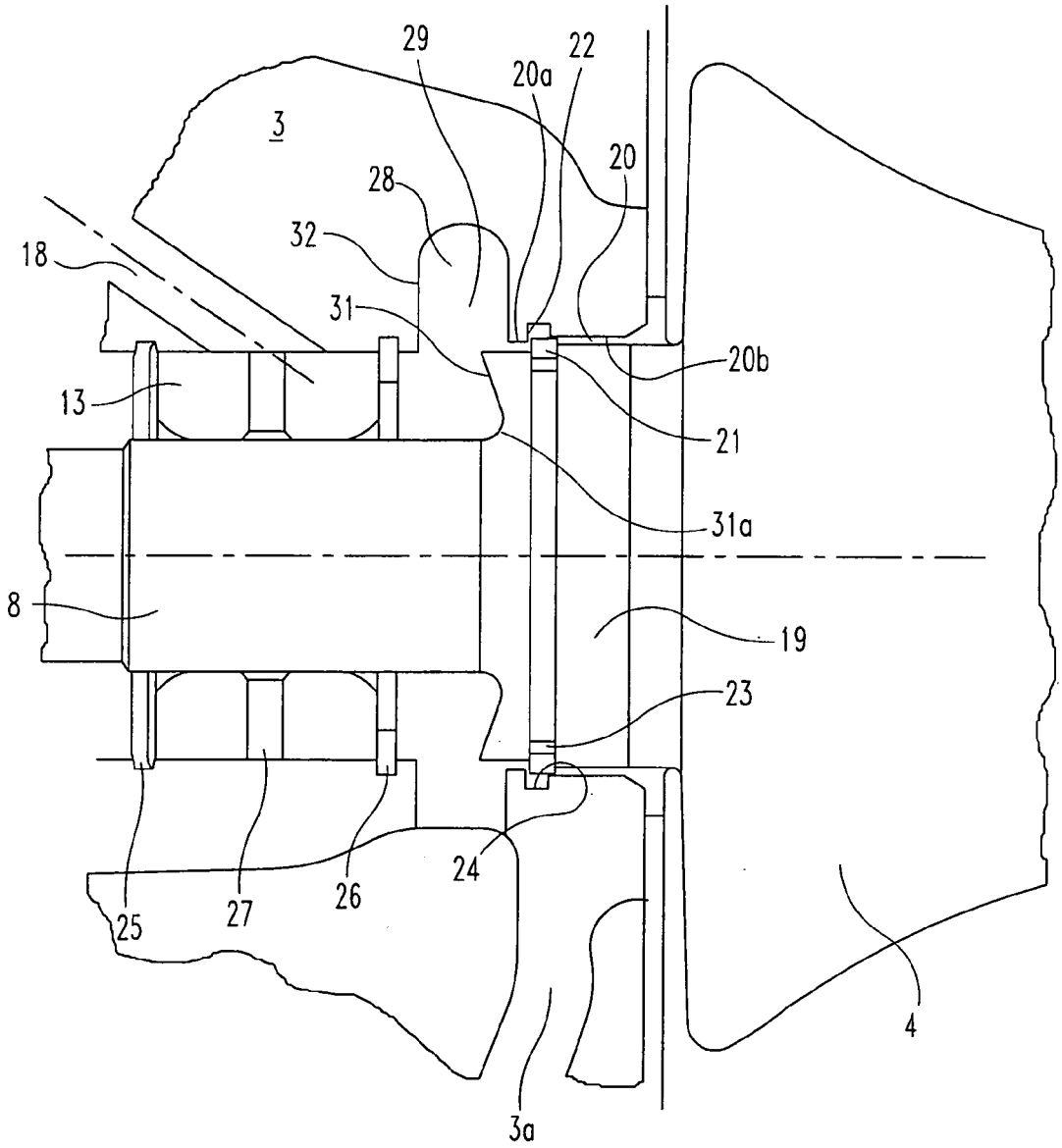
FIG. 3 illustrates a modification of the turbine wheel and shaft assembly of FIG. 2 in accordance with the present invention.

Referring to FIG. 3, the illustrated assembly is identical to that of FIG. 2, except that in accordance with the present invention the annular face 31 of the seal boss 19 is machined with an undercut so that rather than extending strictly radially from the shaft 8, it extends at an angle away from the passage 20 through the bearing housing wall 3*a*. In one form an inner edge 31*a* is radiused to provide a smooth transition from the axial surface of the shaft 8 to the annular face 31. Thus as the shaft 8 rotates, oil present on the annular face 31 is projected not only radially away from the shaft 8, but also axially away from the passage 20. In this particular embodiment, the oil will be projected on to a side surface 32 of the oil groove 28 remote from the passage 20 and thus the likelihood of oil flowing back towards the passage 20 is greatly reduced.

The present invention thus provides an effective method of reducing oil leakage across the turbine end seal without adding any additional components to the seal assembly, and with only minimal modification to conventional turbocharger components, namely appropriate profiling of the annular face of the seal boss 19.

It will be appreciated that the exact profile of the annular seal boss face 31 may vary from that illustrated provided it has the effect of propelling oil in a direction having an axial component away from the passage 20.

It will also be appreciated that details of the shaft bearing and oil seal arrangements may be entirely conventional, and vary from those illustrated. For instance, the oil seal may comprise more than one ring seal 21 and the passage 20 may be a plain bore of constant diameter. Similarly, the detailed form of the bearing housing and turbine housing may vary from that illustrated. For example, in the illustrated embodiment the passage from the bearing housing to the turbine housing is formed in a wall of the bearing housing. In other arrangements the wall separating the two housings may form part of the turbine housing rather than the bearing housing.

It will also be appreciated that the exact form of the oil groove 28 may vary. For instance, in some turbocharger bearing housing designs the oil groove may extend nearly 360° around the shaft, and in others the groove may extend through a smaller angle. Again, the details of the oil groove 28 can be entirely conventional. Alternatively, the oil groove could be modified by angling the side walls of the groove, and in particular the inboard side wall to enhance the oil collecting performance.

Other possible modifications of the invention will be readily apparent to the appropriately skilled person.

The invention claimed is:

1. A turbocharger comprising:

a turbine wheel mounted to a seal boss provided at one end of a shaft for rotation about an axis with a turbine housing;

a compressor wheel mounted to the other end of the shaft for rotation about said axis within a compressor housing;

the shaft rotating on bearing assemblies housed within a bearing housing located between the compressor housing and the turbine housing and provided with oil passages for delivering oil to the bearing assemblies;

the turbine wheel being separated from the interior of the bearing housing by a housing wall;

the seal boss extending through an annular passage provided through said housing wall and sealed with respect thereto by seal means disposed within an annular gap defined around the seal boss within the annular passage;

the seal boss having an inboard axial end which extends into the bearing housing and has an annular face forming a radial shoulder around the shaft;

the bearing housing defining an oil collecting groove radially recessed into the bearing housing adjacent said bearing housing wall and having an opening at least partially surrounding the shaft and axially overlapping the inboard end of the seal boss;

wherein the annular face of the seal boss is angled relative to a radial plane extending through the shaft so that as the shaft rotates oil present on the annular face of the seal boss is projected into the oil collecting groove in a direction radially away from the shaft and axially away from the passage through said housing wall.

2. A turbocharger according to claim 1, wherein said annular boss face has a radially outer circumferential edge and a radially inner circumferential edge, said outer edge overhanging the inner edge.

3. A turbocharger according to claim 2, wherein said inner edge is radiused to provide a smooth transition from the axial surface of the shaft to the annular seal boss face.

4. A turbocharger according to claim 1, wherein the annular face of the seal boss is substantially frusto-conical.

5. A turbocharger according to claim 1, wherein the angled seal boss face is formed by forming a recess in a substantially radially extending face.

6. A turbocharger according to claim 1, wherein the oil collecting groove has first and second facing side walls, the first side wall being inboard relative to the second side wall, and wherein the annular face of the seal boss is angled to project oil on to the second side wall of the oil collecting groove.

7. A turbocharger according to claim 6, wherein the first side wall of the oil collecting groove is continuous with said bearing housing wall through which said passage extends.

8. A turbocharger according to claim 6, wherein said bearing housing wall defines said first side wall of the oil collecting groove.

9. A turbocharger according to claim 1, wherein said seal means comprises at least one seal ring.

10. A turbocharger according to claim 9, wherein said at least one seal ring locates in a annular groove provided in a radially outer surface of the seal boss.

* * * * *